US008299881B2

(12) United States Patent
Moon et al.

(10) Patent No.: US 8,299,881 B2
(45) Date of Patent: Oct. 30, 2012

(54) TRANSFORMER IMPROVED IN LEAKAGE INDUCTANCE

(75) Inventors: Gun Woo Moon, Daejeon (KR); Tae Won Heo, Gyunggi-do (KR); Chong Eun Kim, Daejeon (KR); Ki Bum Park, Daejeon (KR); Don Sik Kim, Gyunggi-do (KR); Jong Pil Kim, Gyunggi-do (KR); Sang Cheol Bong, Gyunggi-do (KR); Dong Wook Lee, Gyunggi-do (KR); Dong Joong Kim, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 212 days.

(21) Appl. No.: 12/907,497

(22) Filed: Oct. 19, 2010

(65) Prior Publication Data

US 2011/0032062 A1 Feb. 10, 2011

Related U.S. Application Data

(62) Division of application No. 12/193,543, filed on Aug. 18, 2008, now abandoned.

(30) Foreign Application Priority Data

Dec. 27, 2007 (KR) ..... 10-2007-139338

(51) Int. Cl.
*H01F 27/28* (2006.01)

(52) U.S. Cl. ..... 336/170

(58) Field of Classification Search ..... 336/170, 336/178, 180–184, 212, 214, 215, 220
See application file for complete search history.

(56) References Cited

U.S. PATENT DOCUMENTS

| | | | | |
|---|---|---|---|---|
| 2,173,905 | A * | 9/1939 | Kalbskopf | 363/77 |
| 2,513,512 | A | 7/1950 | Olthof | |
| 4,055,740 | A * | 10/1977 | Nakamura et al. | 219/663 |
| 4,156,222 | A | 5/1979 | Rossman et al. | |
| 4,249,229 | A | 2/1981 | Hester | |
| 4,902,942 | A | 2/1990 | El-Hamamsy | |
| 5,355,296 | A * | 10/1994 | Kuo et al. | 363/43 |
| 5,555,494 | A | 9/1996 | Morris | |
| 7,034,647 | B2 | 4/2006 | Yan et al. | |
| 7,136,293 | B2 | 11/2006 | Petkov et al. | |
| 7,375,607 | B2 | 5/2008 | Lee et al. | |
| 8,125,205 | B2 * | 2/2012 | Chandrasekaran et al. | 323/282 |

OTHER PUBLICATIONS

Korean Notice of Office Action for Application No. 10-2007-0139338, issued Apr. 29, 2010.

* cited by examiner

*Primary Examiner* — Tuyen Nguyen
(74) *Attorney, Agent, or Firm* — Lowe, Hauptman, Ham & Berner, LLP

(57) ABSTRACT

There is provided a transformer improved in leakage inductance including: a core having first, second and third legs electromagnetically coupled to one another; a primary winding formed of a conductor having one end and another end receiving power from the outside and dividedly wound around the first, second and third legs; and a secondary winding wound around at least one of the first, second and third legs and receiving induced power by electromagnetic induction with the primary winding.

1 Claim, 6 Drawing Sheets

TRANSFORMER IMPROVED IN LEAKAGE INDUCTANCE

RELATED APPLICATIONS

This is a Divisional application of U.S. application Ser. No. 12/193,543 filed Aug. 18, 2008, which is based on, and claims priority of Korean Patent Application No. 2007-139338 filed on Dec. 27, 2007. The disclosures of the above applications are hereby incorporated by reference in its entirety.

BACKGROUND OF THE INVENTION

1. Field of the Invention

The present invention relates to a transformer, and more particularly, to a transformer applied to a power conversion circuit, which is improved in leakage inductance due to unbalanced coupling between a primary winding and a secondary winding.

2. Description of the Related Art

To date, a variety of power conversion circuits with high power density have been developed. Generally, high-frequency driving is essentially required to increase power density of a switching-mode power conversion circuit.

However, such increase in a switching frequency leads to a switching loss proportional thereto, thereby decreasing overall power conversion efficiency. Therefore, a variety of soft-switching circuits for diminishing the switching loss have been in development.

Representative examples include an active clamp forward converter, an unbalanced driving half-bridge converter, a phase-shift control full bridge converter, and a resonant converter. These circuits perform zero voltage switching by utilizing leakage inductance of a transformer mainly used in power conversion.

The range of the zero voltage switching operation entirely depends on energy of the leakage inductance of the transformer. Therefore, typically, in a case where the leakage inductance of the transformer is small, an additional resonant inductor is connected to the power conversion circuit to assure the range of zero voltage switching. However, the additional resonant inductor connected as described above increases complexity and size of the circuit, while also suffering core and conduction losses.

SUMMARY OF THE INVENTION

An aspect of the present invention provides a transformer applicable to a power conversion circuit, in which a primary winding receiving power and a secondary winding receiving induced power from the primary winding to supply to a rear end of the transformer are electromagnetically and unbalancedly coupled to improve leakage inductance.

According to an aspect of the present invention, there is provided a transformer improved in leakage inductance including: a core having first, second and third legs electromagnetically coupled to one another; a primary winding formed of a conductor having one end and another end receiving power from the outside and dividedly wound around the first, second and third legs, respectively; and a secondary winding wound around at least one of the first, second and third legs and receiving induced power by electromagnetic induction with the primary winding.

The core may have the first leg formed at one side thereof, the second leg formed at another side thereof to be electromagnetically coupled to the first leg, and the third leg formed between the first and second legs to be electromagnetically coupled to the first and second legs.

In the primary winding dividedly wound around the first, second and third legs, turns of the primary winding wound around the first leg may be identical in number to turns of the primary winding wound around the second leg.

The secondary winding is wound around the third leg.

The secondary winding may be dividedly wound around the first and second legs, respectively.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
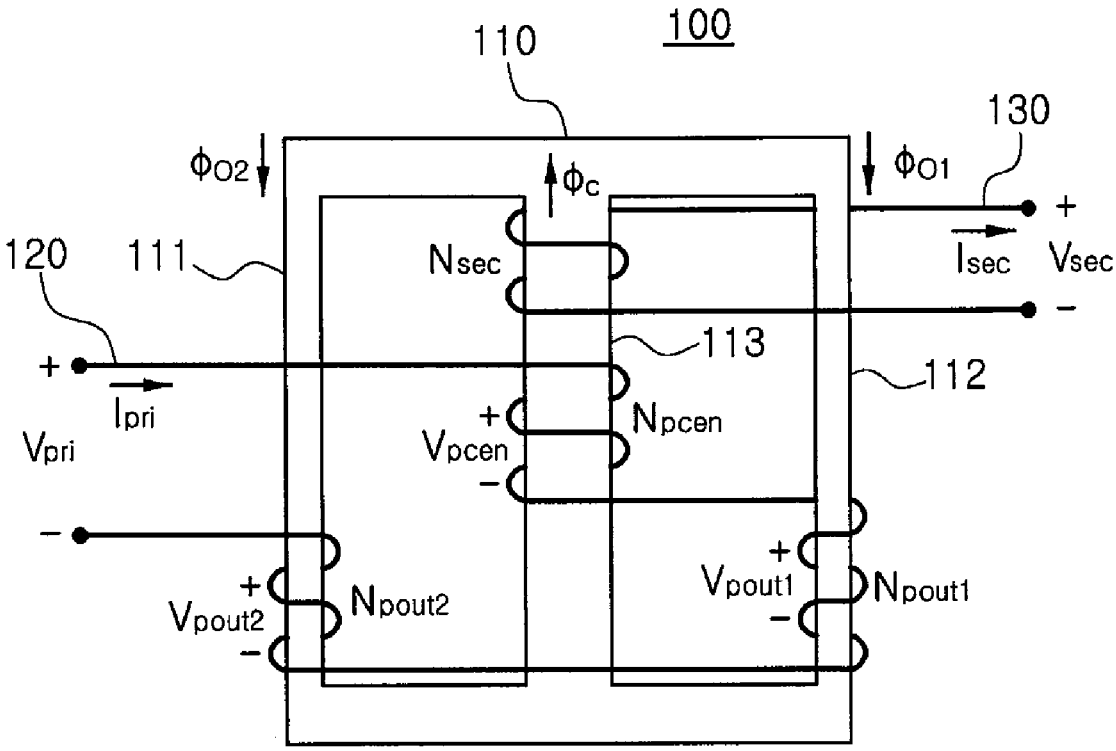
FIG. 1 is a configuration view illustrating a transformer according to an exemplary embodiment of the invention.

FIG. 1 is a configuration view illustrating a transformer according to an exemplary embodiment of the invention.

Referring to FIG. 1, the transformer 100 of the present embodiment includes a core 110, a primary winding 120 and a secondary winding 130. Also, although not shown, the transformer 100 may further include a bobbin formed of an insulator, where the primary winding 120 and the secondary winding 130 can be wound around the core. The bobbin is not illustrated because it is obvious to those skilled in the art that the bobbin is required for winding the coil around the core in the transformer. That is, the bobbin is not illustrated due to lack of technical features thereof in the present embodiment.

The core 110 typically includes an EE core and an EI core coupled together, and accordingly has at least tree legs electromagnetically coupled to one another. That is, as shown, first to third legs 111, 112, and 113 may be formed, but more than three legs may be formed depending on various shapes of the core.

The primary winding 120 is formed of one conductor having one end and another end, and may be dividedly wound Npout2, Npout1, and Npcen around the first to third legs 111, 112, and 113, respectively according to a predetermined number of turns. Power Vpri and Ipri is supplied to the one end and another end of the primary winding 120 from the outside.

Also, the secondary winding 130 is formed of one conductor having one end and another end, and may be wound around at least one of the first to third legs 111, 112, and 113 according to a predetermined number of turns. Here, as shown, the secondary winding 130 may be wound Nsec around the third leg 113. From the one end and another end of the secondary winding 130, power Vsec and Isec induced by electromagnetic induction according to a winding ratio between the primary winding 120 and the secondary winding 130 may be outputted.

When it comes to electrical relations of the transformer according to the present embodiment, when the primary winding 120 is dividedly wound around the first to third legs 111,112 and 113, respectively, and the numbers of turns wound around the first and second legs are equal to each other, the numbers of turns satisfy Npout1=Npout2=Npout. Accordingly, a voltage applied to each of sub-windings of the primary winding 120 satisfies Vpout1=Vpout2=Vpout, and each flux satisfies Φ1=Φ2=Φo. Here, the sub-windings of the primary winding 120 are portions of the primary winding 120 dividedly wound around the first to third legs 111, 112 and 113, respectively.

Therefore, total voltage applied to the primary winding 120 satisfies following Equation 1.

$$V_{pri}=V_{pcen}+2V_{pout} \quad \text{Equation 1}$$

In a case where Vpri is a positive voltage, magnetic flux of each of the legs 111,112, and 113 is increased in a direction identical to a reference direction (indicated with arrows) of the flux. This accordingly fulfills following Equation 2.

$$p<\Phi_c>=p<2\Phi_o> \quad \text{Equation 2.}$$

Here, P<x> denotes a change in the magnetic flux of x per unit time.

The voltages applied to the sub-windings of the respective legs according to Equation 2 satisfy following Equation 3, $$\frac{V_{pcen}}{N_{pcen}}=2\frac{V_{pout}}{N_{pout}} \quad \text{Equation 3}$$

Thus, Equations 1 to 3 fulfill Equation 4.

$$\frac{V_{sec}}{V_{pri}}=\frac{N_{sec}}{N_{pcen}+N_{pout}} \quad \text{Equation 4}$$

Accordingly, currents flowing to the primary winding 120 and the secondary winding 130 satisfy following Equation 5.

$$\frac{I_{sec}}{I_{pri}}=\frac{N_{pout}+N_{pcen}}{N_{sec}} \quad \text{Equation 5}$$

Based on Equation 5, the current of the primary winding and the current of the secondary winding have relations according to a winding ratio as in a conventional transformer. That is, even though the primary winding 120 is dividedly wound around the first to third legs 111,112, and 113, respectively and the secondary winding 130 is wound around at least one of the first to third legs 111,112, and 113, the transformer of the present embodiment has identical electrical characteristics to the conventional transformer.

Figure 2:
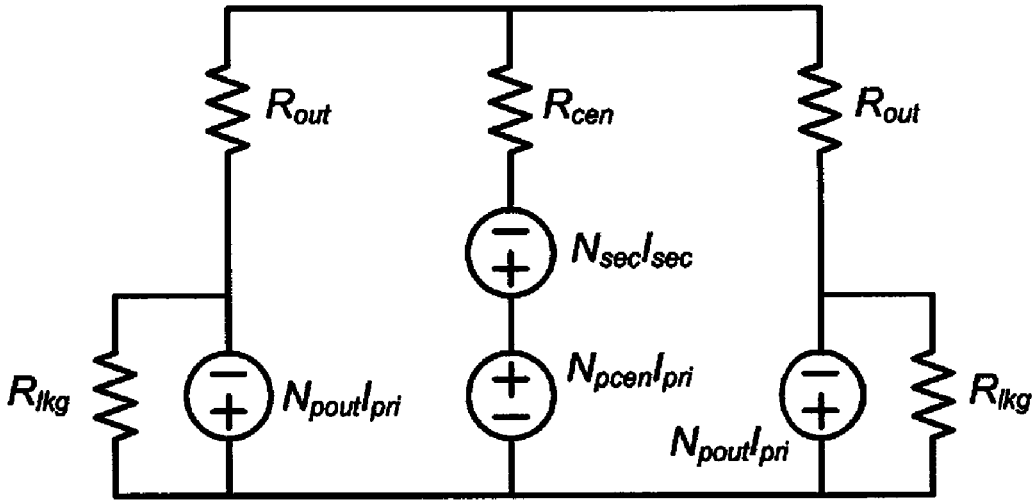
FIG. 2 is a diagram illustrating an electromagnetic equivalent circuit in view of leakage magnetic resistance according to an exemplary embodiment of the invention.

FIG. 2 is a diagram illustrating a magnetic equivalent circuit in view of leakage magnetic resistance of a transformer according to an exemplary embodiment of the invention.

Referring to FIG. 2 together with FIG. 1, leakage magnetic resistance Rlkg is formed on the sub-windings of the first and second legs 111 and 112, respectively due to low electromagnetic coupling between the primary winding 120 and the secondary winding 130.

Figure 3:
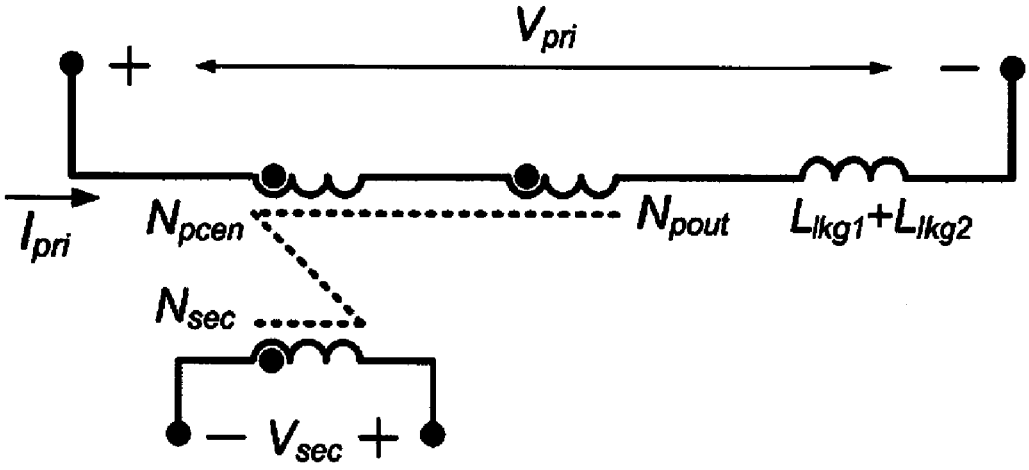
FIG. 3 illustrates an electrical equivalent circuit of a transformer according to an exemplary embodiment of the invention.

An electrical equivalent circuit seen from the Npout is shown in FIG. 3.

FIG. 3 illustrates an electrical equivalent circuit according to an exemplary embodiment of the invention.

Referring to FIGS. 1 to 3, it is assumed that in the electrical equivalent circuit of FIG. 3, magnetic resistance Rcent of the third leg and magnetic resistances Rout of the first and second legs are sufficiently big, and reference signs Llkg1 and Llkg2 denote leakage inductors resulting from Rlkg.

As shown in FIG. 3, the transformer of the present embodiment includes a primary winding 120 (Npcen+Npout), a secondary winding 130 (Nsec), and has leakage inductors Llkg1 and Llkg2 due to unbalanced electromagnetic coupling between the primary winding 120 and the secondary winding 130.

Figure 4:
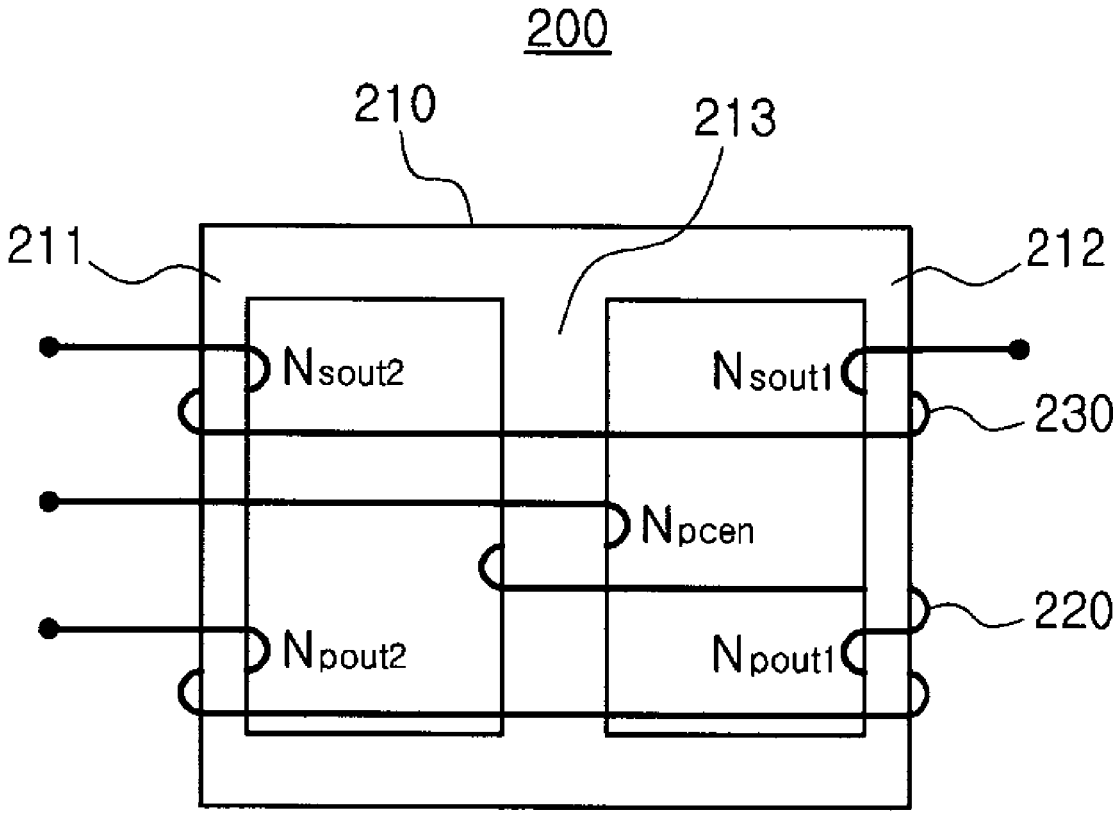
FIG. 4 is a configuration view illustrating a transformer according to another exemplary embodiment of the invention.

FIG. 4 is a configuration view illustrating a transformer according to another exemplary embodiment of the invention.

Referring to FIG. 4 together with FIG. 1, the transformer 200 of the present embodiment includes a core 210 having first, second and third legs 211,212, and 213, a primary winding 220 and a secondary winding 230 in the same manner as the transformer 100 of the previous embodiment. Here, the secondary winding 230 is dividedly wound around the first and second legs 211 and 212, respectively, unlike the previous embodiment.

In the same manner, the unbalanced electromagnetic coupling occurs between the primary winding 220 and the secondary winding 230, thereby generating leakage inductance.

The transformer 200 of the present embodiment described above has electrical characteristics identical to the previous embodiment, and thus will not be described in further detail.

Figure 5A:
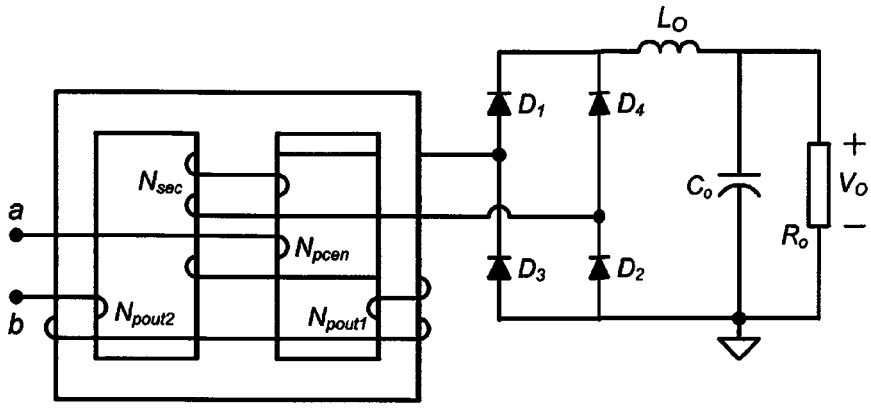
FIGS. 5A to 5C are diagrams illustrating power conversion circuits having a transformer of an exemplary embodiment of the invention applied thereto, respectively.
Figure 5B:
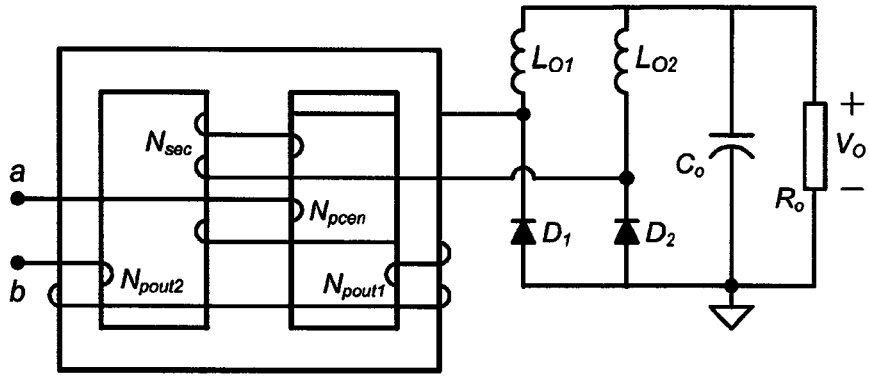
Figure 5C:
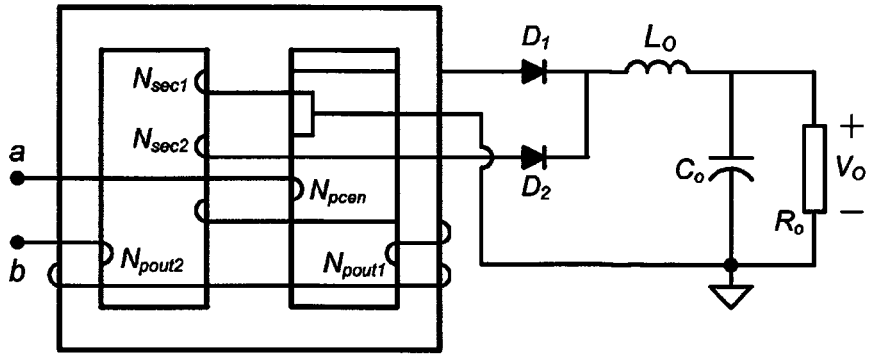

FIGS. 5A to 5C are diagrams illustrating power conversion circuits having the transformer of an exemplary embodiment of the invention applied thereto, respectively.

Referring to FIG. 5 together with FIGS. 1 and 4, the transformer of the present embodiment shown in FIG. 1 is applied to the power conversion circuits, respectively.

FIG. 5A illustrates a full bridge circuit including four diodes D1 to D4, an inductor Lo and a capacitor Co. FIG. 5B illustrates a current doubler circuit including two diodes D1 and D2, two inductors Lo1 and Lo2 and a capacitor Co. FIG. 5C illustrates a power conversion circuit of a center tap type including two diodes D1, and D2 connected at a center tap of the secondary winding Nsec1 and Nsec2, an inductor Lo and a capacitor Co. The transformer of the present embodiment shown in FIG. 1 is applied to the circuits, but the transformer according to another exemplary embodiment of the invention, for example, shown in FIG. 4, may be applied to the circuits.

Figure 6:
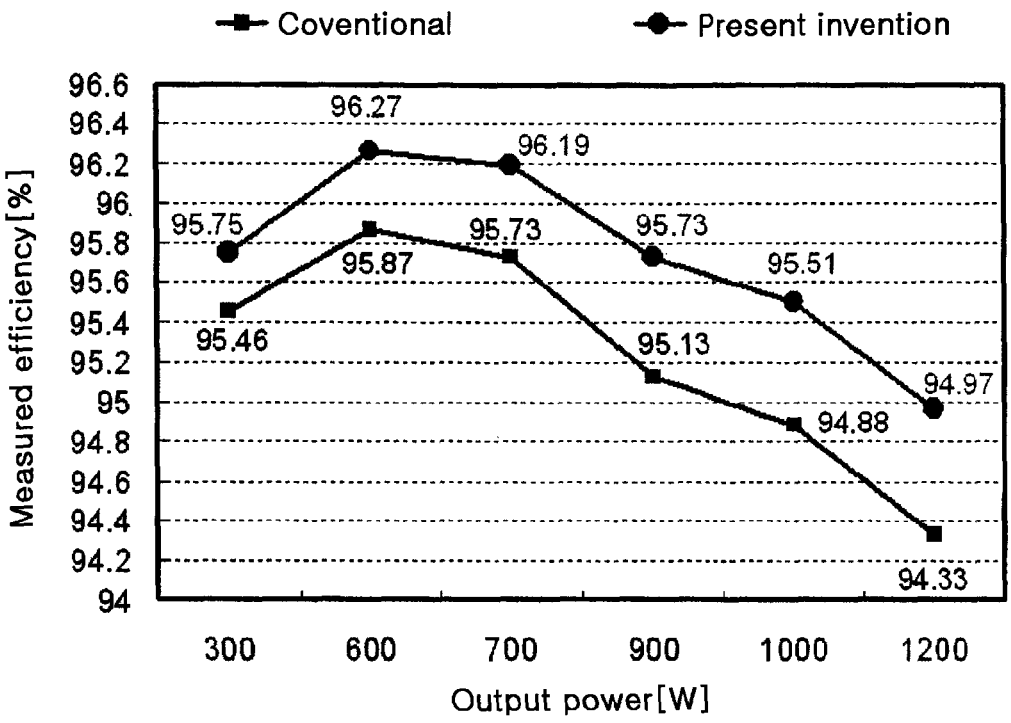
FIG. 6 is a graph illustrating comparison results of power conversion efficiency between a power conversion circuit having a conventional transformer applied thereto and a power conversion circuit having a transformer of an exemplary embodiment of the invention applied thereto, respectively.

FIG. 6 is a graph illustrating comparison results of power conversion efficiency between a power conversion circuit having a conventional transformer applied thereto and a power conversion circuit having a transformer of an exemplary embodiment of the invention applied thereto, respectively.

Referring to FIG. 6, the conventional transformer and the transformer of the present embodiment are applied to full bridge power conversion circuits which had an input voltage of 400V, an output voltage of 12V and a rated power of 1.2 KW. In a case where the conventional transformer is applied, an additional resonant inductor of 7 uH is connected to the circuit.

As shown in FIG. 6, compared to the power conversion circuit adopting the conventional transformer and the additional resonant inductor, the power conversion circuit employing the transformer of the present embodiment exhibits higher efficiency of about 0.3% to 0.6%. This power conversion circuit of the present embodiment which does not require the additional resonant inductor is decreased in size commensurate with an occupational area of the additional resonant inductor.

As set forth above, according to exemplary embodiments of the invention, in a transformer applied to a power conversion circuit, a primary winding receiving power and a secondary winding receiving induced power from the primary winding to supply to a rear end of the transformer are coupled electromagnetically and unbalancedly to increase leakage inductance. This increases leakage inductance, thus precluding a need for an additional resonant inductor. This consequently ensures higher efficiency of the power conversion circuit, smaller circuit area and lower manufacturing costs.

While the present invention has been shown and described in connection with the exemplary embodiments, it will be apparent to those skilled in the art that modifications and variations can be made without departing from the spirit and scope of the invention as defined by the appended claims.

What is claimed is:

1. A transformer having improved leakage inductance comprising:

a core having first, second and third legs electromagnetically coupled to one another;

a primary winding formed of a conductor having one end and another end for receiving outside power and dividedly wound around the first, second and third legs, respectively; and a secondary winding wound around at least one of the first, second and third legs and receiving induced power by electromagnetic induction with the primary winding;

wherein the core has the first leg formed at one side thereof, the second leg formed at another side thereof to be electromagnetically coupled to the first leg, and the third leg formed between the first and second legs to be electromagnetically coupled to the first and second legs;

wherein in the primary winding dividedly wound around the first, second and third legs, turns of the primary winding wound around the first leg are identical in number to turns of the primary winding wound around the second leg; and wherein the secondary winding is dividedly wound around the first and second legs, respectively.

* * * * *